US010311778B2

(12) United States Patent
Lee

(10) Patent No.: US 10,311,778 B2
(45) Date of Patent: Jun. 4, 2019

(54) DISPLAY DEVICE INCLUDING A DEGRADATION COMPENSATOR AND ELECTRONIC DEVICE HAVING THE SAME

(71) Applicant: SAMSUNG DISPLAY CO., LTD., Yongin-si, Gyeonggi-do (KR)

(72) Inventor: Wook Lee, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 119 days.

(21) Appl. No.: 15/194,281

(22) Filed: Jun. 27, 2016

(65) Prior Publication Data

US 2017/0076660 A1 Mar. 16, 2017

(30) Foreign Application Priority Data

Sep. 14, 2015 (KR) ..... 10-2015-0129525

(51) Int. Cl.
*G09G 3/3208* (2016.01)
*G09G 3/20* (2006.01)

(52) U.S. Cl.
CPC ..... *G09G 3/3208* (2013.01); *G09G 3/2003* (2013.01); *G09G 2320/029* (2013.01); *G09G 2320/0276* (2013.01); *G09G 2320/045* (2013.01); *G09G 2320/048* (2013.01); *G09G 2330/021* (2013.01)

(58) Field of Classification Search
CPC ..... G09G 3/2003; G09G 3/32–3/3291; G09G 2320/0204; G09G 2320/2019; G09G 2320/0223; G09G 2320/0233; G09G 2320/0242; G09G 2320/0271; G09G 2320/0276; G09G 2320/029; G09G 2320/0295; G09G 2320/043–2320/048; G09G 2320/0666; G09G 2320/0673; G09G 2330/021; G09G 2330/10
See application file for complete search history.

(56) References Cited

U.S. PATENT DOCUMENTS

2008/0088648 A1 4/2008 Nathan et al.
2012/0162285 A1* 6/2012 Yamashita ..... G09G 3/32 345/690

(Continued)

FOREIGN PATENT DOCUMENTS

KR 10-2013-0100601 A 9/2013
KR 10-2014-0051745 A 5/2014
KR 10-2014-0078500 A 6/2014

*Primary Examiner* — Nathan Danielsen
(74) *Attorney, Agent, or Firm* — Lewis Roca Rothgerber Christie LLP

(57) ABSTRACT

A display device includes: a display panel including a plurality of pixels; a power voltage generator to generate a high power voltage that is provided to the pixels through a high power line; a degradation compensator to calculate a degradation degree of the pixels by measuring a power current flowing through the high power voltage line, and to calculate a compensation amount of a degradation of the pixels based on the degradation degree of the pixels and image data provided to the pixels; a scan driver to provide scan signals to the pixels; a data driver to provide data signals to the pixels; and a timing controller to generate control signals to control the power voltage generator, the degradation compensator, the scan driver, and the data driver.

20 Claims, 6 Drawing Sheets

(56) References Cited

U.S. PATENT DOCUMENTS

| | | | | |
|---|---|---|---|---|
| 2014/0320553 | A1* | 10/2014 | Eom | G09G 3/3208 345/690 |
| 2015/0048881 | A1* | 2/2015 | Kwon | H03H 19/004 327/554 |
| 2015/0091884 | A1* | 4/2015 | Yang | G09G 3/3283 345/205 |
| 2016/0027382 | A1* | 1/2016 | Chaji | G09G 3/006 345/212 |

* cited by examiner

DISPLAY DEVICE INCLUDING A DEGRADATION COMPENSATOR AND ELECTRONIC DEVICE HAVING THE SAME

CROSS-REFERENCE TO RELATED APPLICATION

This application claims priority to and the benefit of Korean Patent Application No. 10-2015-0129525, under 35 USC § 119, filed on Sep. 14, 2015 in the Korean Intellectual Property Office (KIPO), the contents of which are incorporated herein in its entirety by reference.

BACKGROUND

1. Field

One or more aspects of example embodiments of the present inventive concept relate generally to a display device. More particularly, one or more aspects of example embodiments of the present inventive concept relate to a display device and an electronic device having the same.

2. Description of the Related Art

Flat panel display (FPD) devices are widely used as a display device of electronic devices, because FPD devices are relatively lightweight and thin compared to cathode-ray tube (CRT) display devices. Examples of FPD devices include liquid crystal display (LCD) devices, field emission display (FED) devices, plasma display panel (PDP) devices, and organic light emitting display (OLED) devices. The OLED devices have been spotlighted as the next-generation display devices, because the OLED devices have a wide viewing angle, a rapid response speed, a thin thickness, low power consumption, etc.

An organic light emitting diode included in a pixel of the OLED device may be degraded as time passes. Luminance of the pixel that is emitted corresponding to a data signal may be reduced as the organic light emitting diode is degraded. Thus, a compensating method of the degradation of the organic light emitting diode has been studied.

The above information disclosed in this Background section is for enhancement of understanding of the background of the invention, and therefore, it may contain information that does not constitute prior art.

SUMMARY

One or more example embodiments provide a display device capable of compensating a degradation of pixels.

One or more example embodiments provide an electronic device capable of compensating a degradation of pixels in a display device.

According to an example embodiment of the inventive concept, a display device includes: a display panel including a plurality of pixels; a power voltage generator configured to generate a high power voltage that is provided to the pixels through a high power voltage line; a degradation compensator configured to calculate a degradation degree of the pixels by measuring a power current flowing through the high power voltage line, and to calculate a compensation amount of a degradation of the pixels based on the degradation degree of the pixels and image data provided to the pixels; a scan driver configured to provide scan signals to the pixels; a data driver configured to provide data signals to the pixels; and a timing controller configured to generate control signals to control the power voltage generator, the degradation compensator, the scan driver, and the data driver.

In an embodiment, the degradation compensator may include: a sensing block including a sensing circuit configured to calculate an amount of the degradation corresponding to the degradation degree of the pixels based on the power current; and a compensation amount calculator configured to calculate the compensation amount of the degradation of the pixels based on the amount of the degradation of the pixels and an accumulation amount of the image data.

In an embodiment, the sensing circuit may include an integrator configured to integrate the power current.

In an embodiment, the compensation amount calculator may be configured to divide the display panel into a plurality of regions, and to calculate the compensation amount of the degradation of each of the regions by multiplying the amount of the degradation provided from the sensing block by a ratio of the accumulation amount of the image data provided to all of the regions to the accumulation amount of the image data provided to each of the regions.

In an embodiment, the degradation compensator may include: a sensing block including: a first sensing circuit configured to calculate an amount of degradation of red pixels; a second sensing circuit configured to calculate an amount of degradation of green pixels; and a third sensing circuit configured to calculate an amount of degradation of blue pixels; and a compensation amount calculator configured to calculate each of the compensation amount of the degradation of the red pixels, the compensation amount of the degradation of the green pixels, and the compensation amount of the degradation of the blue pixels, based on the amount of the degradation of the red pixels, the amount of the degradation of the green pixels, the amount of the degradation of the blue pixels and an accumulation amount of red image data, green image data, and blue image data.

In an embodiment, each of the first sensing circuit, the second sensing circuit, and third sensing circuit may include an integrator configured to integrate the power current.

In an embodiment, the sensing block may further include a noise eliminator configured to reduce noise of the power current.

In an embodiment, the compensation amount calculator may be configured to: divide the display panel into a plurality of regions; calculate the compensation amount of the degradation of the red pixels of each of the regions by multiplying the amount of the degradation of the red pixels provided from the sensing block by a ratio of the accumulation amount of the red image data provided to all of the regions to the accumulation amount of the red image data provided to each of the regions; calculate the compensation amount of the degradation of the green pixels of each of the regions by multiplying the amount of the degradation of the green pixels provided from the sensing block by a ratio of the accumulation amount of the green image data provided to all of the regions to the accumulation amount of the green image data provided to each of the regions; and calculate the compensation amount of the degradation of the blue pixels of each of the regions by multiplying the amount of the degradation of the blue pixels provided from the sensing block by a ratio of the accumulation amount of the blue image data provided to all of the regions to the accumulation amount of the blue image data provided to each of the regions.

In an embodiment, the degradation compensator may be coupled to the power voltage generator or located in the power voltage generator.

In an embodiment, the degradation compensator may be coupled to the timing controller or located in the timing controller.

According to an example embodiment of the inventive concept, an electronic device including a display device and a processor configured to control the display device, includes: a display panel including a plurality of pixels; a power voltage generator configured to generate a high power voltage that is provided to the pixels through a high power line; a degradation compensator configured to calculate a degradation degree of the pixels by measuring a power current flowing through the high power line, and to calculate a compensation amount of a degradation of the pixels based on the degradation degree of the pixels and image data provided to the pixels; a scan driver configured to provide scan signals to the pixels; a data driver configured to provide data signals to the pixels; and a timing controller configured to generate control signals to control the power voltage generator, the degradation compensator, the scan driver, and the data driver.

In an embodiment, the degradation compensator may include: a sensing block including a sensing circuit configured to calculate an amount of the degradation corresponding to the degradation degree of the pixels based on the power current; and a compensation amount calculator configured to calculate the compensation amount of the degradation of the pixels based on the amount of the degradation of the pixels and an accumulation amount of the image data.

In an embodiment, the sensing circuit may include an integrator configured to integrate the power current.

In an embodiment, the compensation amount calculator may be configured to divide the display panel into a plurality of regions, and to calculate the compensation amount of the degradation of each of the regions by multiplying the amount of the degradation provided from the sensing block by a ratio of the accumulation amount of the image data provided to all of the regions to the accumulation amount of the image data provided to each of the regions.

In an embodiment, the degradation compensator may include: a sensing block including: a first sensing circuit configured to calculate an amount of degradation of red pixels; a second sensing circuit configured to calculate an amount of degradation of green pixels; and a third sensing circuit configured to calculate an amount of degradation of blue pixels; and a compensation amount calculator configured to calculate each of the compensation amount of the degradation of the red pixels, the compensation amount of the degradation of the green pixels, and the compensation amount of the degradation of the blue pixels, based on the amount of the degradation of the red pixels, the amount of the degradation of the green pixels, the amount of the degradation of the blue pixels and an accumulation amount of red image data, green image data, and blue image data.

In an embodiment, each of the first sensing circuit, the second sensing circuit, and third sensing circuit may include an integrator configured to integrate the power current.

In an embodiment, the sensing block may further include a noise eliminator configured to reduce noise of the power current.

In an embodiment, the compensation amount calculator may be configured to: divide the display panel into a plurality of regions; calculate the compensation amount of the degradation of the red pixels of each of the regions by multiplying the amount of the degradation of the red pixels provided from the sensing block by a ratio of the accumulation amount of the red image data provided to all of the regions to the accumulation amount of the red image data provided to each of the regions; calculate the compensation amount of the degradation of the green pixels of each of the regions by multiplying the amount of the degradation of the green pixels provided from the sensing block by a ratio of the accumulation amount of the green image data provided to all of the regions to the accumulation amount of the green image data provided to each of the regions; and calculate the compensation amount of the degradation of the blue pixels of each of the regions by multiplying the amount of the degradation of the blue pixels provided from the sensing block by a ratio of the accumulation amount of the blue image data provided to all of the regions to the accumulation amount of the blue image data provided to each of the regions.

In an embodiment, the degradation compensator may be coupled to the power voltage generator or located in the power voltage generator.

In an embodiment, the degradation compensator may be coupled to the timing controller or located in the timing controller.

Therefore, a display device and an electronic device having the same according to one or more example embodiments of the present inventive concept may calculate an amount of degradation of pixels, and may compensate for the degradation of the pixel. Thus, a life time of the pixels may be extended.

BRIEF DESCRIPTION OF THE DRAWINGS

The above and other aspects and features of the present inventive concept will be more clearly understood from the following detailed description of the illustrative, non-limiting example embodiments with reference to the accompanying drawings.

DETAILED DESCRIPTION

Figure 1:
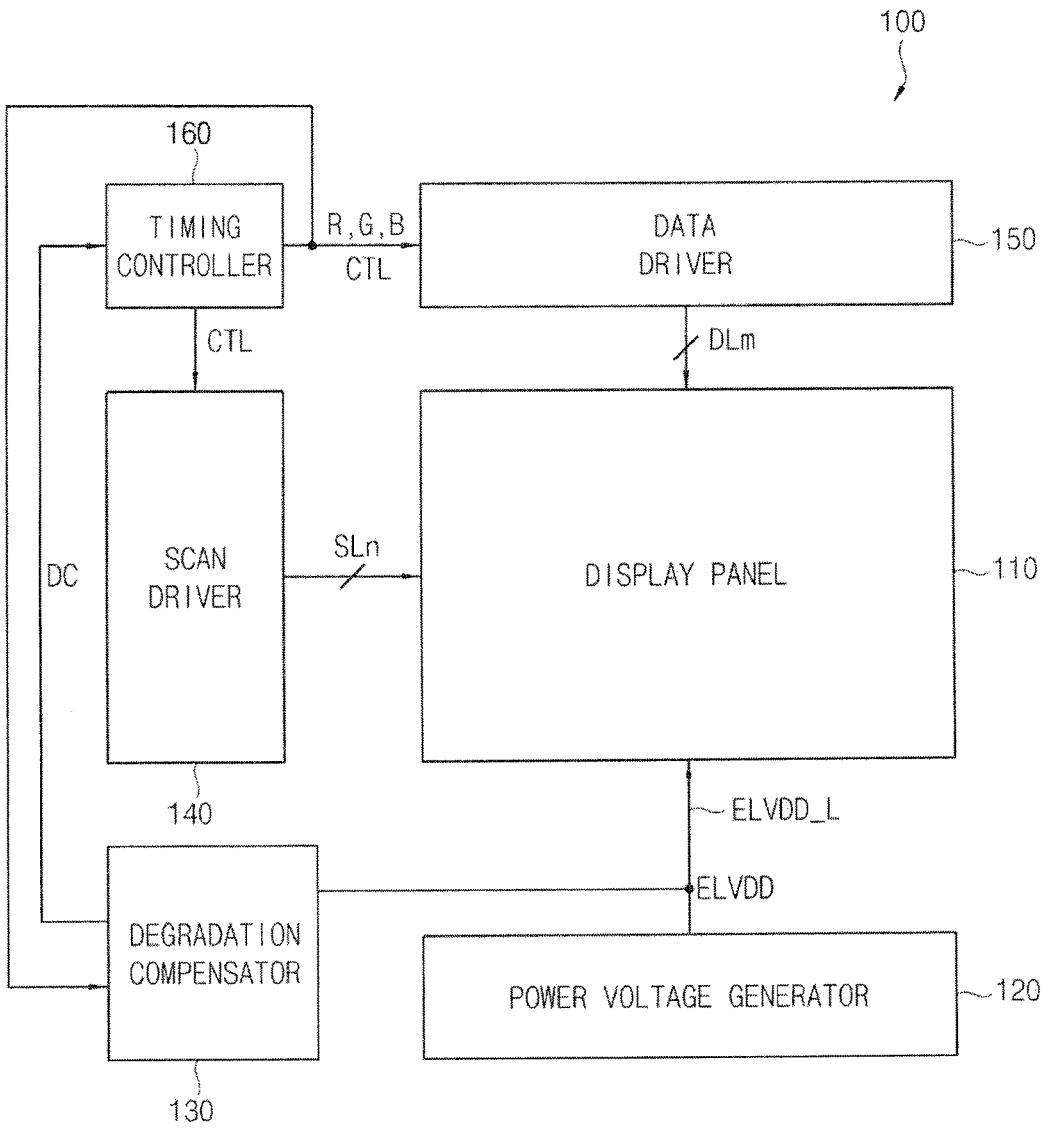
FIG. 1 is a block diagram illustrating a display device according to an example embodiment of the inventive concept.

Hereinafter, example embodiments will be described in more detail with reference to the accompanying drawings. The present inventive concept, however, may be embodied in various different forms, and should not be construed as being limited to only the illustrated embodiments herein. Rather, these embodiments are provided as examples so that this disclosure will be thorough and complete, and will fully convey the aspects and features of the inventive concept to those skilled in the art. Accordingly, processes, elements, and techniques that are not necessary to those having ordinary skill in the art for a complete understanding of the aspects and features of the inventive concept may not be described. Unless otherwise noted, like reference numerals denote like elements throughout the attached drawings and the written description, and thus, descriptions thereof may not be repeated.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the inventive concept.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the inventive concept refers to "one or more embodiments of the inventive concept." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a display device according to an example embodiment of the inventive concept.

Referring to FIG. 1, a display device 100 may include a display panel 110, a power voltage generator 120, a degradation compensator 130, a scan driver 140, a data driver 150, and a timing controller 160.

The display panel 110 may include a plurality of pixels. In some example embodiments, each of the pixels may include a pixel circuit, a driving transistor, and an organic light emitting diode. In this case, the driving transistor may control a driving current flowing through the organic light emitting diode based on a data signal. The data signal is provided to the driving transistor via a data line DLm in response to a scan signal, and the scan signal is provided via a scan line SLn.

The power voltage generator 120 may generate a high power voltage ELVDD that is provided to the pixels through a high power voltage line ELVDD_L. The power voltage generator 120 may generate the high power voltage ELVDD to drive the pixels in the display panel 110. The high power voltage ELVDD may be provided to the pixels through the high power voltage line ELVDD_L.

In some example embodiments, the power voltage generator 120 may provide the high power voltage ELVDD having the same or substantially the same voltage level to red pixels, green pixels, and blue pixels in the display panel 110 through the one high power voltage line ELVDD_L.

In other example embodiments, the power voltage generator 120 may provide a first high power voltage to the red pixels through a first high power voltage line, a second high power voltage to the green pixels through a second high power voltage line, and a third high power voltage to the blue pixels through a third high power voltage. In some example embodiments, the first high power voltage, the second high power voltage, and the third high power voltage may have the same or substantially the same voltage level. In other example embodiments, the first high power voltage, the second high power voltage, and the third high power voltage may have different voltage levels from each other. Here, the red pixels may be the pixels that emit red color light, the green pixels may be the pixels that emit green color light, and the blue pixels may be the pixels that emit blue color light.

The power voltage generator 120 may generate a low power voltage and may provide the low power voltage to the pixels through a lower power voltage line. The power voltage generator 120 may not generate the high power voltage ELVDD while a sensing block of the degradation compensator 130 is operated.

The degradation compensator 130 may calculate an amount of the degradation that represents a degradation degree of the pixels by measuring a power current flowing through the high power voltage line ELVDD_L. The degradation compensator 130 may calculate a compensation amount of a degradation DC of the pixels based on the amount of the degradation and image data R, G, B provided to the pixels. As time passes, a power current flowing through the high power voltage line ELVDD_L may be changed, because the organic light emitting diode included in the pixel is degraded. Therefore, the degradation degree of the pixels may be calculated using a change amount of the power current flowing through the high power voltage line ELVDD_L.

The sensing block may include a sensing circuit to calculate the amount of the degradation of the pixels based on the power current. The sensing circuit may be coupled to the high power voltage line ELVDD_L. The sensing circuit may sense the power current flowing through the high power voltage line ELVDD_L. The sensing block may include an integrator, and may calculate the amount of the degradation of the pixels by integrating the power current that is sensed.

In some example embodiments, the sensing block may include one sensing circuit, when the high power voltage ELVDD is provided to the red pixels, the green pixels, and the blue pixels in the display panel 110 through the one high power voltage line ELVDD_L. The sensing circuit may sense the power current flowing through the high power voltage line ELVDD_L by being coupled to the high power voltage line ELVDD_L. The sensing circuit may calculate the amounts of the degradation of the red pixels, the green pixels, and the blue pixels by integrating the power current.

In other example embodiments, the sensing block may include a first sensing circuit that calculates the amount of the degradation of the red pixels, a second sensing circuit that calculates the amount of the degradation of the green pixels, and a third sensing circuit that calculates the amount of the degradation of the blue pixels, when a first high power voltage is provided to the red pixels in the display panel 110 through a first high power voltage line, a second high power voltage is provided to the green pixels in the display panel 110 through a second high power voltage line, and a third high power voltage is provided to the blue pixels in the display panel 110. The first sensing circuit may sense the power current flowing through the first high power voltage line by being coupled to the first high power voltage line, and may calculate the amount of the degradation of the red pixels by integrating the power current. The second sensing circuit may sense the power current flowing through the second high power voltage line by being coupled to the second high power voltage line, and may calculate the amount of the degradation of the green pixels by integrating the power current. The third sensing circuit may sense the power current flowing through the third high power voltage line by being coupled to the third high power voltage line, and may calculate the amount of the degradation of the blue pixels by integrating the power current.

The degradation compensator may further include a noise eliminator for eliminating a noise of the power current.

The compensation amount calculator may calculate the compensation amount of the degradation DC of the pixels based on the amount of the degradation of the pixels and an accumulation amount of the image data R, G, B. The compensation amount calculator may divide the display panel 110 into a plurality of regions. The compensation amount calculator may calculate the compensation amount of the degradation DC of each of the regions by multiplying the amount of the degradation provided from the sensing block by a ratio of the accumulation amount of the image data R, G, B provided to all regions to the accumulation amount of the image data R, G, B provided to each of the regions.

The sensing block may measure the amount of the degradation of all of the pixels in the display panel 110. Here, the compensation amount calculator may determine the compensation amount of the degradation DC of each of the regions to be proportional to the accumulation amount of the image data R, G, B provided to each of the regions, because the amount of the degradation of each of the regions may be different from each other. The compensation amount calculator may output the compensation amount of the degradation DC to the timing controller 160. The timing controller 160 may compensate the image data R, G, B based on the compensation amount of the degradation DC.

In some example embodiments, the compensation amount calculator may divide the display pane 110 into the plurality of regions, and may calculate the compensation amount of the degradation DC of each of the regions. The compensation amount of the degradation DC of each of the regions may be calculated by multiplying the amount of the degradation of the red pixels, the green pixels, and the blue pixels by the ratio of the accumulation amount of the image data R, G, B provided to all regions to the accumulation amount of the image data R, G, B provided to each of the regions, when the high power voltage ELVDD is provided to the red pixels, the green pixels, and the blue pixels in the display panel 110 through the one high power voltage line ELVDD_L.

In other example embodiments, the compensation amount calculator may calculate each of the compensation amount of the degradation of the red pixels of each of the regions, the compensation amount of the degradation of the green pixels of each of the regions, and the compensation amount of the degradation of the blue pixels of each of the regions based on the accumulation amount of red image data R, the accumulation amount of green image data G, and the accumulation amount of blue image data B, when a first high power voltage is provided to the red pixels in the display panel 110 through the first high power voltage line, a second high power voltage is provided to the green pixels in the display panel 110 through the second high power voltage line, and a third high power voltage is provided to the blue pixels in the display panel 110 through the third high power voltage line.

The compensation amount calculator may calculate the compensation amount of the red pixels of each of the regions by multiplying the amount of the degradation of the red pixels by the ratio of the accumulation amount of the red image data provided to all regions to the accumulation amount of the red image data provided to each of the regions. The compensation amount calculator may calculate the compensation amount of the green pixels of each of the regions by multiplying the amount of the degradation of the green pixels by the ratio of the accumulation amount of the green image data provided to all regions to the accumulation amount of the green image data provided to each of the regions. The compensation amount calculator may calculate the compensation amount of the blue pixels of each of the regions by multiplying the amount of the degradation of the blue pixels by the ratio of the accumulation amount of the blue image data provided to all regions to the accumulation amount of the blue image data provided to each of the regions.

According to an embodiment, the degradation compensator 130 may be located in the power voltage generator 120, although the degradation compensator 130 that is coupled to the power voltage generator 120 is shown in the embodiment of FIG. 1. However, the present inventive concept is not limited thereto, and in another embodiment, the degradation compensator 130 may be coupled to the timing controller 160, or may be located in the timing controller 160.

The scan driver 140 may provide the scan signals to the pixels through the scan lines SLn. The data driver 150 may provide the data signals to the pixels through the data lines DLm. The timing controller 160 may generate control signals CTL to control the scan driver 140 and the data driver 150. Further, the timing controller 160 may compensate the image data R, G, B based on the compensation amount of the degradation DC provided from the degradation compensator 130. For example, the timing controller 160 may compensate for the degradation of the pixels by changing a grayscale value of the image data R, G, B, and/or by controlling a driving current provided to the pixels.

As described above, the display device 100 of FIG. 1 may include the degradation compensator 130 to compensate for the degradation of the pixels of each of the regions. The degradation compensator 130 may calculate the amount of the degradation of the pixels by sensing the power current, and may calculate the compensation amount of the degradation DC of each of the regions based on the amount of the degradation and the amount of the accumulation of the image data R, G, B provided to the pixels. Thus, the display device 100 of FIG. 1 may correctly compensate for the degradation of the pixels without a change to the display panel 110 and/or a driving IC.

Figure 2:
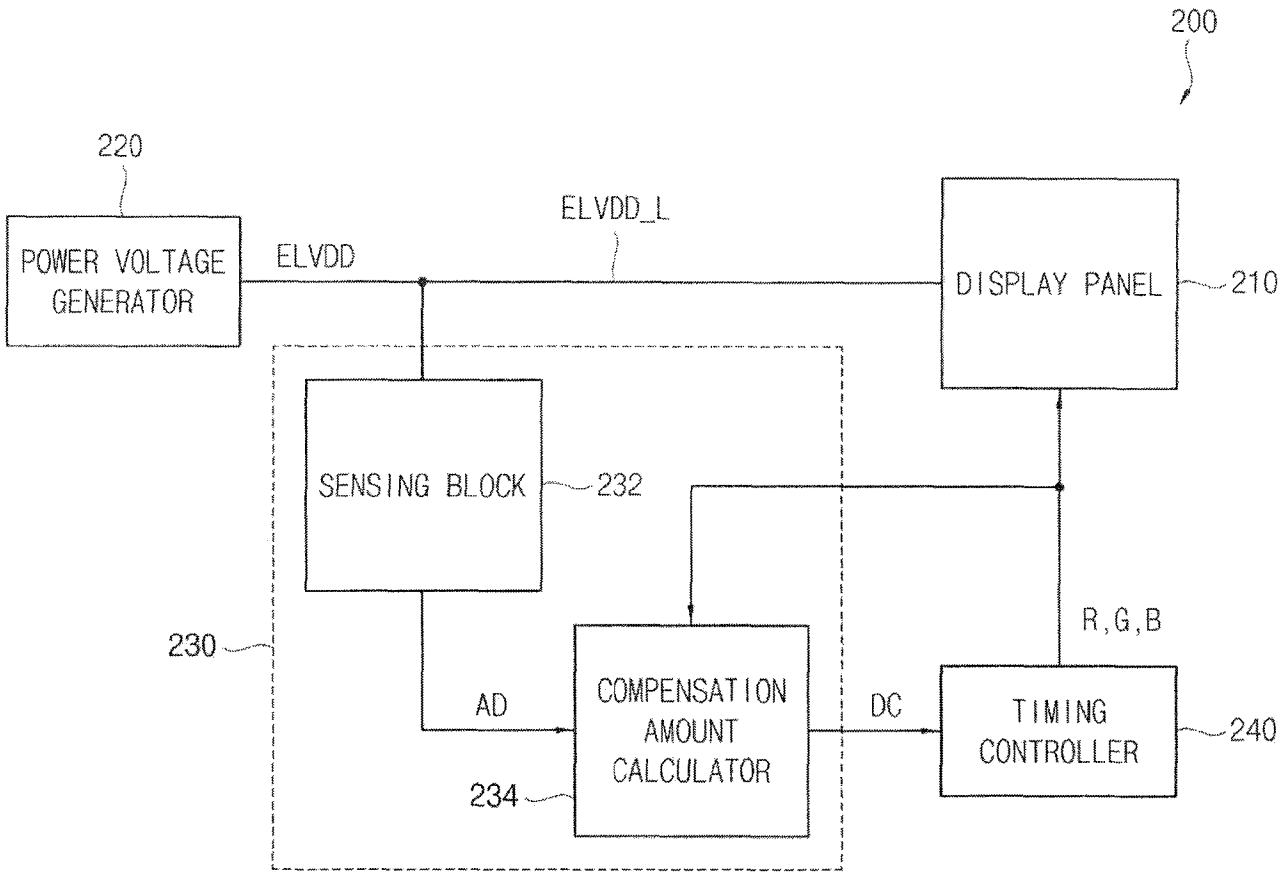
FIG. 2 is a block diagram illustrating an example of a degradation compensator coupled to the display device of FIG. 1.
Figure 3:
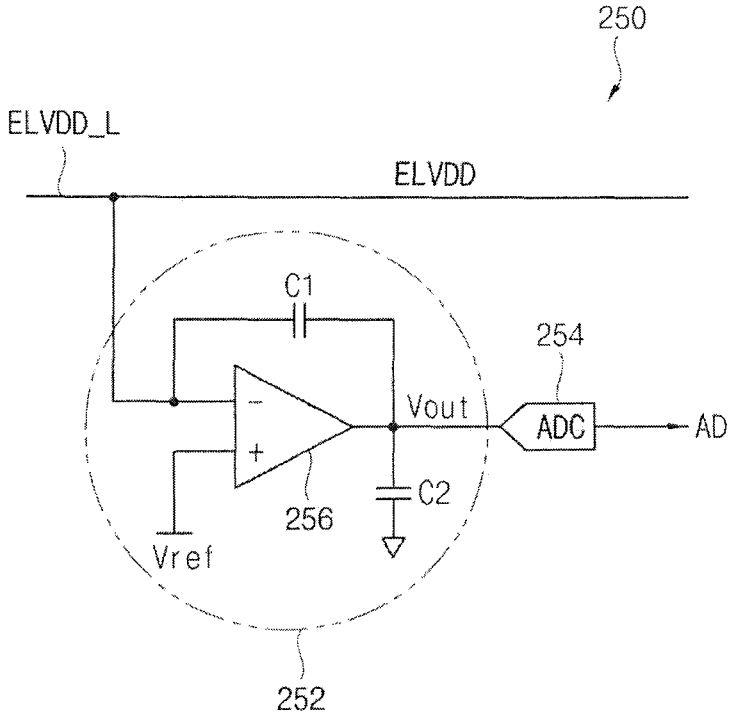
FIG. 3 is a block diagram illustrating a sensor included in the display device of FIG. 1.

FIG. 2 is a block diagram illustrating an example of a degradation compensator coupled to the display device of FIG. 1, and FIG. 3 is a block diagram illustrating a sensor included in the display device of FIG. 1.

Referring to FIGS. 2 and 3, the display device 200 may include a display panel 210, a power voltage generator 220, a degradation compensator 230, and a timing controller 240. The display panel 210 may include a plurality of pixels. A data driving IC that converts image data R, G, B into a voltage (e.g., an analog voltage) corresponding to a grayscale value, and provides the voltage to the pixels as a data signal is located on the display panel 210.

The power voltage generator 220 may generate a high power voltage ELVDD that is provided to the pixels through a high power voltage line ELVDD_L. The power voltage generator 220 may provide the high power voltage ELVDD to the pixels (e.g., red pixels, green pixels, and blue pixels) of the display panel 210 through the high power voltage line ELVDD_L. The power voltage generator 220 may not generate the high power voltage ELVDD when the degradation compensator 230 is operated.

The degradation compensator 230 may calculate an amount of a degradation AD of the pixels by sensing a power current flowing through the high power voltage line ELVDD_L, and may calculate a compensation amount DC of the pixels based on the amount of the degradation AD of the image data R, G, B provided to the pixels. The degradation compensator 230 may include a sensing block 232 and a compensation amount calculator 234.

The sensing block may include a sensing circuit 250 that calculates the amount of the degradation AD of the pixels based on the power current flowing through the high power voltage line ELVDD_L. For example, the sensing circuit 250 may include an integrator 252 as shown in FIG. 3. The integrator 252 may be coupled to the high power voltage line ELVDD_L. The integrator 252 may integrate the power current flowing through the high power voltage line ELVDD_L, and may output an output voltage Vout generated by an integration result.

The integrator 252 may include an amplifier 256 and at least one capacitor (e.g., C1 and C2). A first input terminal (e.g., a - input terminal) of the amplifier may be coupled to the high power voltage line ELVDD_L. A second input terminal (e.g., a + input terminal) of the amplifier may be couple to a reference voltage Vref. An output terminal of the amplifier may be coupled to an analog-digital converter (ADC) 254. The integrator may integrate the power current flowing through the high power voltage line ELVDD_L during a time (e.g., a predetermined time or a frame).

The output voltage Vout of the integrator 252 may be output to the ADC 254. The ADC 254 may convert the output voltage Vout into a digital signal, and may provide the digital signal to the compensation amount calculator 234. Although the sensing circuit 250 including the integrator is shown in FIG. 3, the present inventive concept is not limited thereto. For example, the sensing circuit 250 may include a comparator.

The compensation amount calculator 234 may calculate a compensation amount of the degradation DC of the pixels based on the amount of the degradation AD and an accumulation amount of the image data R, G, B. The compensation amount calculator 234 may include a data accumulation calculator to calculate the accumulation amount of the image data R, G, B. The compensation amount calculator 234 may divide the display panel 210 into a plurality of regions. The data accumulation calculator may calculate the accumulation amount of the image data R, G, B provided to the pixels in each of the regions.

The compensation amount calculator 234 may calculate the compensation amount of the degradation DC of each of the regions by multiplying the amount of the degradation AD by a ratio of the accumulation amount of the image data R, G, B provided to all regions to the accumulation amount of the image data R, G, B provided to each of the regions. That is, the compensation amount of the degradation DC of each of the regions may be proportional to the accumulation amount of the image data R, G, B provided to each of the regions.

The timing controller 240 may compensate the image data R, G, B based on the compensation amount of the degradation DC. For example, the timing controller 240 may compensate for the degradation of the pixels by changing a grayscale value of the image data R, G, B, and/or by controlling a driving current provided to the pixels.

Figure 4:
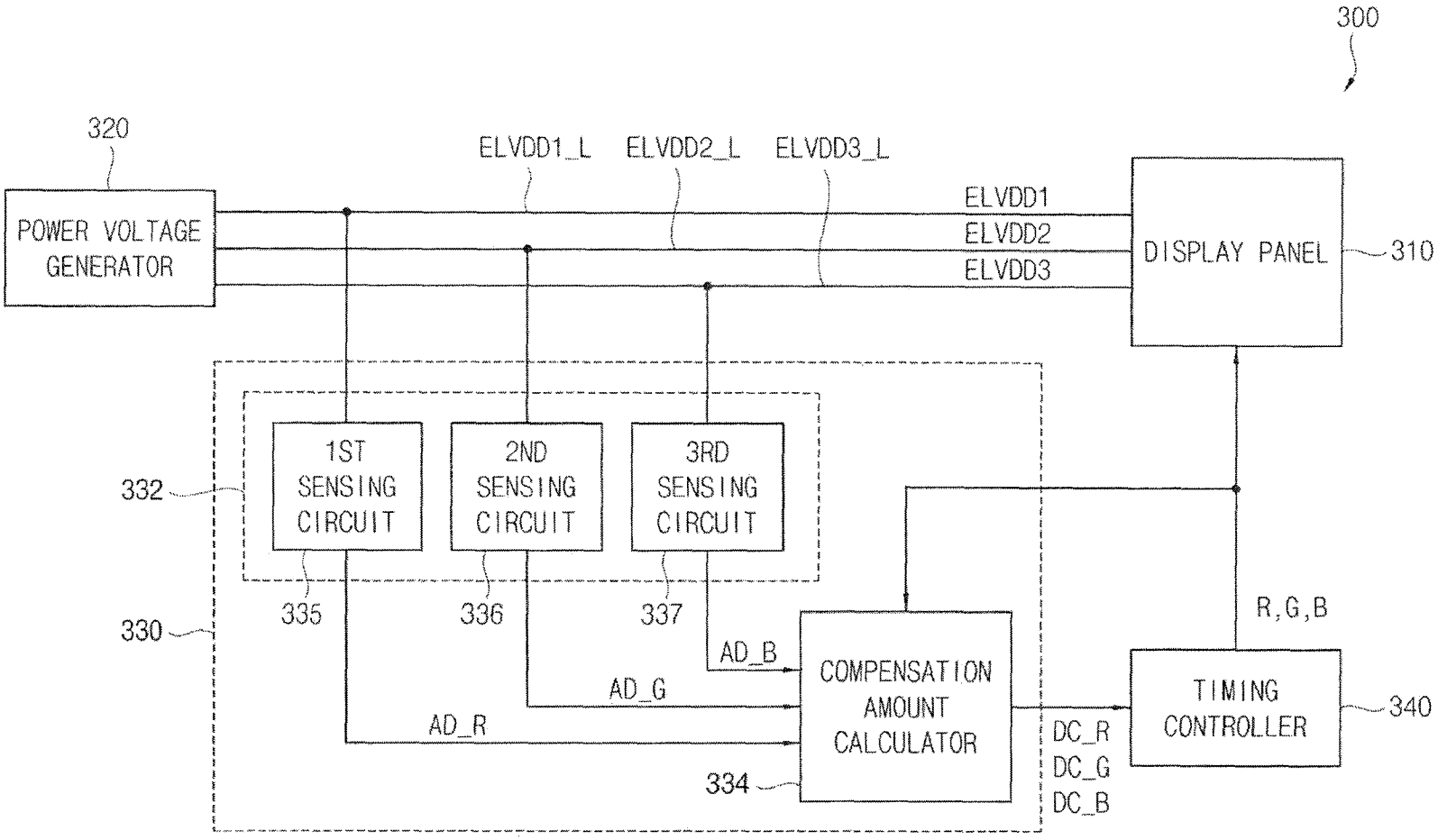
FIG. 4 is a block diagram illustrating another example of a degradation compensator coupled to the display device of FIG. 1.

FIG. 4 is a block diagram illustrating another example of a degradation compensator coupled to the display device of FIG. 1.

Referring to FIG. 4, a display device 300 may include a display panel 310, a power voltage generator 320, a degradation compensator 330, and a timing controller 340. A data driving IC that converts image data R, G, B into a voltage (e.g., an analog voltage) corresponding to a grayscale value, and provides the voltage to the pixels as a data signal is located on the display panel 310.

The power voltage generator 320 may generate high power voltages ELVDD1, ELVDD2, and ELVDD3 provided to the red pixels, green pixels, and blue pixels in the display panel 310 through high power voltage lines ELVDD1_L, ELVDD2_L, and ELVDD3_L. The power voltage generator 320 may provide a first high power voltage ELVDD1 to the red pixels through a first high power voltage line ELVDD1_L.

The power voltage generator 320 may provide a second high power voltage ELVDD2 to the green pixels through a second high power voltage line ELVDD2_L. The power voltage generator 320 may provide a third high power voltage ELVDD3 to the blue pixels through a third high power voltage line ELVDD3_L.

In some example embodiments, the first high power voltage ELVDD1, the second high power voltage ELVDD2, and the third high power voltage ELVDD3 may have the same or substantially the same voltage level. In other example embodiments, the first high power voltage ELVDD1, the second high power voltage ELVDD2, and the third high power voltage ELVDD3 may have different voltage levels from each other.

The power voltage generator 320 may not generate the first high power voltage ELVDD1, the second high power voltage ELVDD2, and the third high power voltage ELVDD3, while the degradation compensator 330 is operated.

The degradation compensator 330 may calculate each of an amount of the degradation of the red pixels AD_R, an amount of the degradation of the green pixels AD_G, and an amount of the degradation of the blue pixels AD_B. The degradation compensator 330 may calculate each of a compensation amount of the red pixels DC_R, a compensation amount of the green pixels DC_G, and a compensation amount of the blue pixels DC_B, based on the amount of the degradation of the red pixels AD_R, the amount of the degradation of the green pixels AD_G, and the amount of the degradation of the blue pixels AD_B and image data R, G, B.

The degradation compensator 330 may include a sensing block 332 and a compensation amount calculator 334. The sensing block 332 may include a first sensing circuit 335 that calculates the amount of the degradation of the red pixels AD_R, a second sensing circuit 336 that calculates the amount of the degradation of the green pixels AD_G, and a third sensing circuit 337 that calculates the amount of the degradation of the blue pixels AD_B. Here, each of the first sensing circuit 335, the second sensing circuit 336, and the third sensing circuit 337 may include an integrator.

The integrator may correspond to the integrator 252 of FIG. 3.

The first sensing circuit 335 may be coupled to the first high power voltage line ELVDD1_L. The first sensing circuit 335 may sense a power current flowing through the first high power voltage line ELVDD1_L, and may calculate the degradation amount of the red pixels AD_R by integrating the power current. The second sensing circuit 336 may be coupled to the second high power voltage line ELVDD2_L. The second sensing circuit 336 may sense a power current flowing through the second high power voltage line ELVDD2_L, and may calculate the degradation amount of the green pixels AD_G by integrating the power current. The third sensing circuit 337 may be coupled to the third high power voltage line ELVDD3_L. The third sensing circuit 337 may sense a power current flowing through the third high power voltage line ELVDD3_L, and may calculate the degradation amount of the blue pixels AD_B by integrating the power current.

The compensation amount calculator 334 may calculate the compensation amount of the degradation of the pixels DC_R, DC_G, DC_B based on the degradation amount of the pixels AD_R, AD_G, AD_B and accumulation amounts of the image data R, G, B. The compensation amount calculator 334 may calculate each of the compensation amount of the degradation of the red pixels DC_R, the compensation amount of the degradation of the green pixels DC_G, and the compensation amount of the degradation of the blue pixels DC_B, based on the amount of the degradation of the red pixels AD_R, the amount of the degradation of the green pixels AD_G, and the amount of the degradation of the blue pixels AD_B and the accumulation amount of red image data R provided to the red pixels, the accumulation amount of green image data G provided to the green pixels, and the accumulation amount of blue image data B provided to the blue pixels.

The compensation amount calculator 334 may calculate the compensation amount of the degradation of the red pixels DC_R of each of the regions by multiplying the amount of the degradation of the red pixels AD_R by a ratio of the accumulation amount of the red image data R provided to all regions to the accumulation amount of the red image data R provided to each of the regions. The compensation amount calculator 334 may calculate the compensation amount of the degradation of the green pixels DC_G of each of the regions by multiplying the amount of the degradation of the green pixels AD_G by a ratio of the accumulation amount of the green image data G provided to all regions to the accumulation amount of the green image data G provided to each of the regions. The compensation amount calculator 334 may calculate the compensation amount of the degradation of the blue pixels DC_B of each of the regions by multiplying the amount of the degradation of the blue pixels AD_B by a ratio of the accumulation amount of the blue image data B provided to all regions to the accumulation amount of the blue image data B provided to each of the regions.

The timing controller 340 may compensate the red image data R based on the compensation amount of the degradation of the red pixels DC_R, may compensate the green image data G based on the compensation amount of the degradation of the green pixels DC_G, and may compensate the blue image data B based on the compensation amount of the degradation of the blue pixels DC_B.

Figure 5:
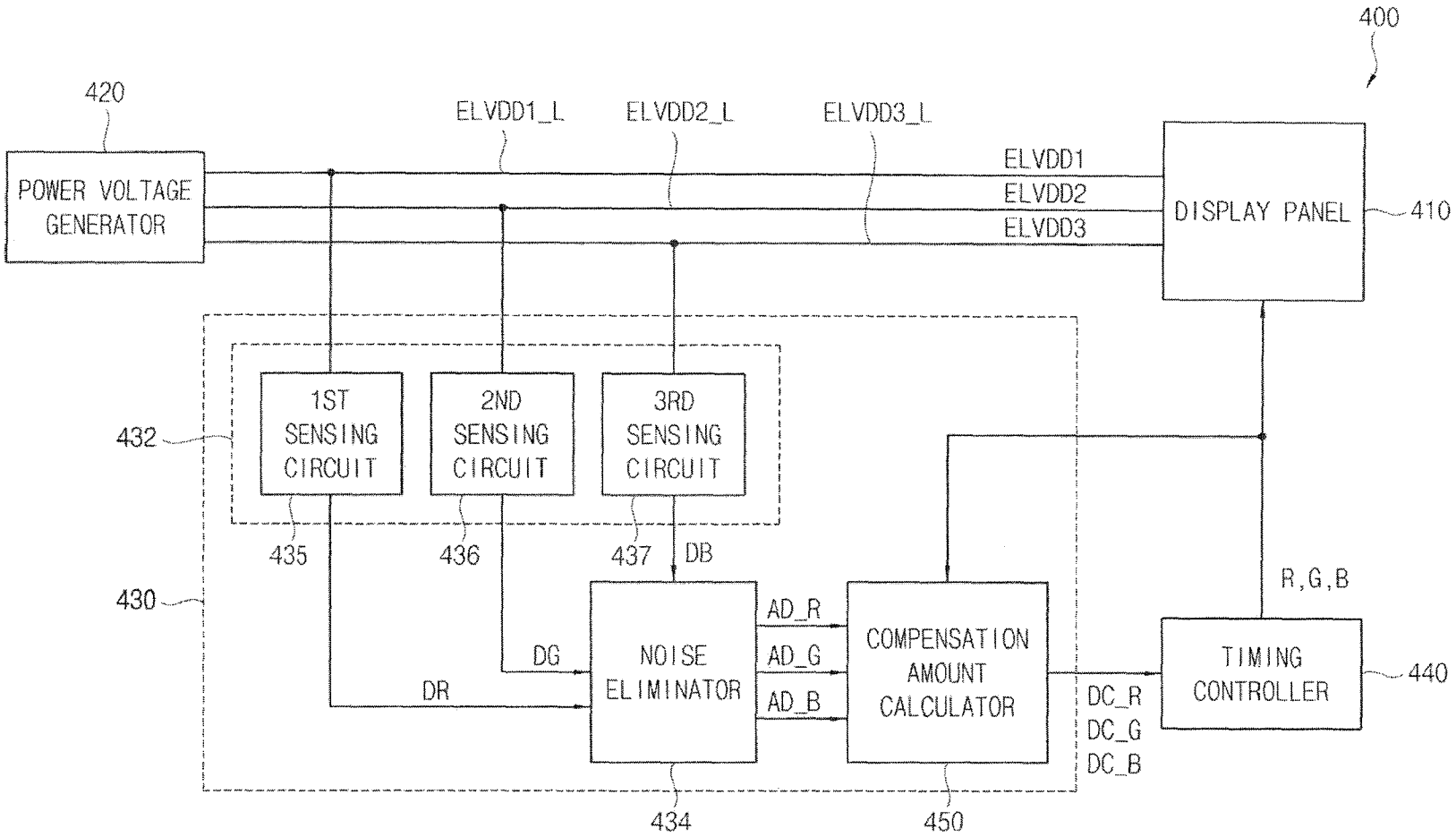
FIG. 5 is a block diagram illustrating another example of a degradation compensator coupled to the display device of FIG. 1.

FIG. 5 is a block diagram illustrating another example of a degradation compensator coupled to the display device of FIG. 1.

Referring to FIG. 5, a display device 400 is substantially the same as the display device 300 of FIG. 4, except that the display device 400 further includes a noise eliminator 434. Accordingly, repeated description of elements and components that are the same or substantially the same as those of FIG. 4 will be omitted.

The noise eliminator 434 may eliminate or reduce noise of the power current by calculating output data DR, DG, DB output from the sensing block 432. Here, the noise may be a leakage current that flows through the high power voltage line.

A first sensing circuit 435 of the sensing block 432 may output an integration value of the power current flowing through the first high power voltage line ELVDD1_L as the red output data DR. A second sensing circuit 436 of the sensing block 432 may output an integration value of the power current flowing through the second high power voltage line ELVDD2_L as the green output data DG. A third sensing circuit 437 of the sensing block 432 may output an integration value of the power current flowing through the third high power voltage line ELVDD3_L as the blue output data DB.

The noise eliminator 434 may eliminate or reduce the noise flowing through the first high power voltage line ELVDD1_L, the noise flowing through the second high power voltage line ELVDD2_L, and/or the noise flowing through the third high power voltage line ELVDD3_L. Thus, the sensing block 432 may correctly calculate the amount of the degradation of the red pixels, the green pixels, and the blue pixels.

The noise eliminator 434 may measure the power currents flowing through the first high power voltage line ELVDD1_L, the second high power voltage line ELVDD2_L, and the third high power voltage line ELVDD3_L, while the red pixels, the green pixels, and the blue pixels are turned on or turned off. For example, the red pixels, the green pixels, and the blue pixels may be turned off during a first period T1.

The noise eliminator 434 may store the red output data DR1 output from the first sensing circuit 435, and the green output data DG1 output from the second sensing circuit 436 during the first period T1. Here, the red output data DR1 output from the first sensing circuit 435 may include a noise element RN flowing through the first high power voltage line ELVDD1_L. The green output data DG1 output from the second sensing circuit 436 may include a noise element GN flowing through the second high power voltage line ELVDD2_L. Thus, during the first period T1: DR1+DG1=RN+GN. Here, DR1 is the red output data output from the first sensing circuit during the first period. DG1 is the green output data output from the second sensing circuit during the first period. RN is the noise element flowing through the first high power voltage line and GN is the noise element flowing through the second high power voltage line during the first period.

Further, the red pixels may be turned on and the green pixels may be turned off during a second period T2. The noise eliminator 434 may store the red output data DR2 output from the first sensing circuit 435 and the green output data DG2 output from the second sensing circuit 436 during the second period T2. Here, the red output data DR2 may include the power current RS and the noise element RN flowing through the first high power voltage line ELVDD1_L. The green output data DG2 may include the noise element GN flowing through the second high power voltage line ELVDD2_L. Thus, during the second period T2: DR2+DG2=RS+RN+GN. Here, DR2 is the red output data output from the first sensing circuit during the second period. DG2 is the green output data output from the second sensing circuit during the second period. RS is the power current flowing through the first high power voltage line, RN is the noise element flowing through the first high power voltage line, and GN is the noise element flowing through the second high power voltage line during the second period.

The noise eliminator 434 may calculate the power current RS flowing through the first high power voltage line ELVDD1_L of which the noise element RN flowing through the first high power voltage line ELVDD1_L is eliminated during a third period T3. The noise eliminator 434 may subtract a sum (RN+GN) of the red output data DR1 and the green output data DG1 output during the first period T1 from a sum (RS+RN+GN) of the red output data DR2 and the green output data DG2 output during the second period T2. Thus, the power current RS flowing through the first high power voltage line ELVDD1_L may be correctly calculated during the third period T3: DR2+DG2−(DR1+DG1)=RS. Here, DR2 is the red output data output from the first sensing circuit during the second period. DG2 is the green output data output from the second sensing circuit during the second period. DR1 is the red output data output from the first sensing circuit during the first period. DG1 is the green output data output from the second sensing circuit during the first period.

The power current RS of which the noise element is eliminated or reduced in the noise eliminator 434 may be provided to the compensation amount calculator 450 as an amount of the degradation of the red pixel AD_R. The noise eliminator 434 may eliminate or reduce the noise of the power current GS flowing through the second high power voltage line ELVDD2_L, and may eliminate or reduce the noise of the power current BS flowing through the third high power voltage line ELVDD3_L using the same or substantially the same method as that described with respect to the power current RS.

Figure 6:
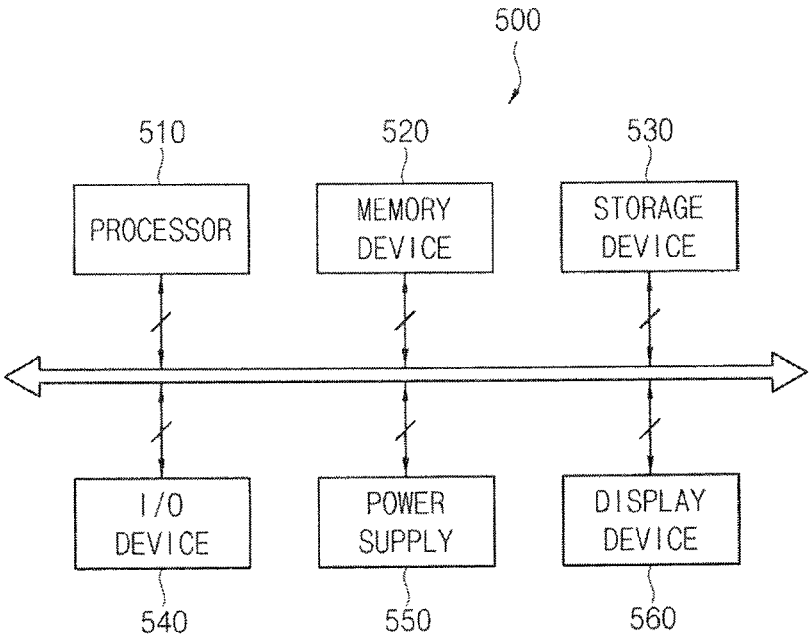
FIG. 6 is a diagram illustrating an electronic device according to an example embodiment.
Figure 7:
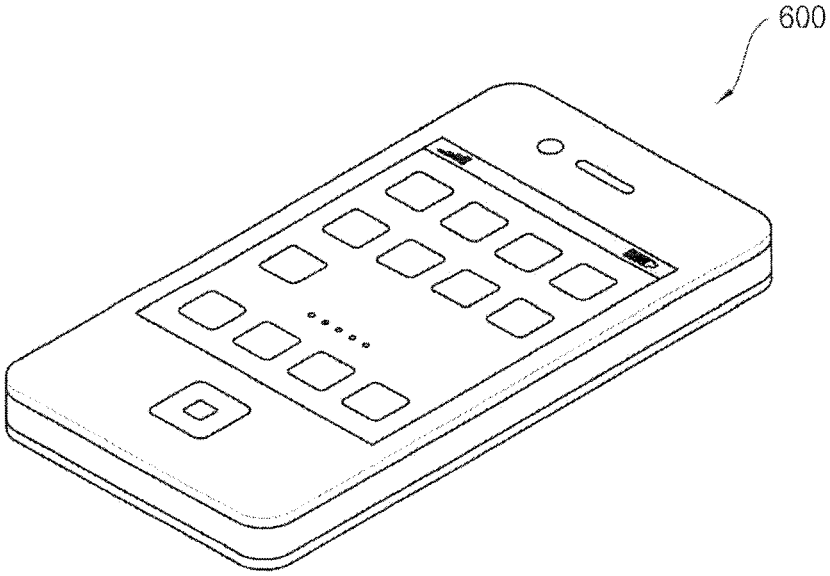
FIG. 7 is a diagram illustrating an example embodiment of the electronic device of FIG. 6 that is implemented as a smart phone.

FIG. 6 is a diagram illustrating an electronic device according to an example embodiment, and FIG. 7 is a diagram illustrating an example embodiment of the electronic device of FIG. 6 that is implemented as a smart phone.

Referring to FIGS. 6 and 7, an electronic device 500 may include a processor 510, a memory device 520, a storage device 530, an input/output (I/O) device 540, a power supply 550, and a display device 560. Here, the display device 560 may correspond to the display device 100 of FIG. 1. In addition, the electronic device 500 may further include a plurality of ports for communicating with a video card, a sound card, a memory card, a universal serial bus (USB) device, other electronic devices, etc. Although it is illustrated in FIG. 7 that the electronic device 500 is implemented as a smart-phone 600, the electronic device 500 of the present inventive concept is not limited thereto.

The processor 510 may perform various computing functions. The processor 510 may include a microprocessor, a central processing unit (CPU), etc. The processor 510 may be coupled to other components via an address bus, a control bus, a data bus, etc. Further, the processor 510 may be coupled to an extended bus, such as peripheral component interconnect (PCI) bus.

The memory device 520 may store data for operations of the electronic device 200. For example, the memory device 520 may include at least one non-volatile memory device, such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device, such as a dynamic random access memory (DRAM) device, a static random access memory (SRAM) device, a mobile DRAM device, etc.

The storage device 530 may include a solid stage drive (SSD) device, a hard disk drive (HDD) device, a CD-ROM device, etc.

The I/O device 540 may include an input device, such as a keyboard, a keypad, a touchpad, a touch-screen, a mouse, etc., and an output device, such as a printer, a speaker, etc. In some example embodiments, the display device 560 may be included in the I/O device 540. The power supply 550 may provide a power for operations of the electronic device 200.

The display device 560 may communicate with other components via the buses or other communication links. As described above, the display device 560 may include a display panel, a power voltage generator, a degradation compensator, a scan driver, a data driver, and a timing controller. The display panel may include a plurality of pixels.

The power voltage generator may generate a high power voltage to drive the plurality of pixels of the display panel. The high power voltage may be provided to the pixels through the high power voltage line.

The degradation compensator may calculate an amount of a degradation of the pixels by measuring the power current flowing through the high power voltage, and may calculate a compensation amount of the pixels based on the amount of the degradation and image data provided to the pixels. The degradation compensator may include a sensing block and a compensation amount calculator.

The sensing block may include a sensing circuit that calculates the amount of the degradation of the pixels based on the power current. The sensing circuit may be coupled to the high power voltage line, and may sense the power current flowing through the high power voltage line. The sensing block may include an integrator. The sensing block may calculate the amount of the degradation of the pixels by integrating the power current. The sensing block may further include a noise eliminator that eliminates a noise of the power current.

The compensation amount calculator may calculate the compensation amount of the degradation of the pixels based on the amount of the degradation and an accumulation amount of the image data. The compensation amount calculator may divide the display panel into a plurality of regions. The compensation amount calculator may calculate the compensation amount of the degradation of each of the regions by multiplying the amount of the degradation provided from the sensing block by a ratio of the accumulation amount of the image data provided to all regions to the accumulation amount of the image data provided to each of the regions. The compensation amount calculator may determine the compensation amount of the degradation to be proportional to the accumulation amount of the image data provided to each of the regions, because the amount of the degradation of each of the regions may be different from each other . The timing controller 160 may compensate the image data based on the compensation amount of the degradation.

As described above, the electronic device 500 may include the display device 560 that compensates for the degradation of the pixels. The display device 560 may include the degradation compensator that calculates the amount of the degradation by sensing the power current flowing through the high power voltage line, and may calculate the compensation amount of the degradation of each of the regions based on the amount of the degradation and the accumulation amount of the image data provided to the image data. Thus, the display device 560 included in the electronic device 500 may correctly compensate for the degradation of the pixels, without change of the display panel and/or a driving IC.

The present inventive concept may be applied to a display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The electronic or electric devices (e.g., the timing controller, the scan driver, the data driver, the compensation amount calculator, the noise eliminator, etc.) and/or any other relevant devices or components according to embodiments of the inventive concept described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the inventive concept.

The foregoing is illustrative of example embodiments and is not to be construed as limiting thereof. Although a few example embodiments have been described, those skilled in the art will readily appreciate that various modifications are possible without departing from the spirit and scope of the present inventive concept. Accordingly, all such modifications are intended to be included within the scope of the present inventive concept as defined in the claims, and their equivalents. Therefore, it is to be understood that the foregoing is illustrative of various example embodiments, and the present inventive concept is not to be construed as limited to the specific example embodiments disclosed herein. Thus, various suitable modifications to the disclosed example embodiments, as well as other example embodiments, are intended to be included within the spirit and scope of the appended claims, and their equivalents.

What is claimed is:

1. A display device comprising:

a display panel comprising a plurality of pixels;

a power voltage generator configured to generate a high power voltage that is provided to the pixels through a high power voltage line;

a degradation compensator configured to calculate a degradation degree of the pixels by measuring a power current flowing through the high power voltage line, and to calculate a compensation amount of a degradation of the pixels based on the degradation degree of the pixels and image data provided to the pixels;

a scan driver configured to provide scan signals to the pixels;

a data driver configured to provide data signals to the pixels; and a timing controller configured to generate control signals to control the power voltage generator, the degradation compensator, the scan driver, and the data driver.

2. The display device of claim 1, wherein the degradation compensator comprises:

a sensing block comprising a sensing circuit configured to calculate an amount of the degradation corresponding to the degradation degree of the pixels based on the power current; and a compensation amount calculator configured to calculate the compensation amount of the degradation of the pixels based on the amount of the degradation of the pixels and an accumulation amount of the image data.

3. The display device of claim 2, wherein the sensing circuit comprises an integrator configured to integrate the power current.

4. The display device of claim 2, wherein the compensation amount calculator is configured to divide the display panel into a plurality of regions, and to calculate the compensation amount of the degradation of each of the regions by multiplying the amount of the degradation provided from the sensing block by a ratio of the accumulation amount of the image data provided to all of the regions to the accumulation amount of the image data provided to each of the regions.

5. The display device of claim 1, wherein the degradation compensator comprises:

a sensing block comprising:

a first sensing circuit configured to calculate an amount of degradation of red pixels;

a second sensing circuit configured to calculate an amount of degradation of green pixels; and a third sensing circuit configured to calculate an amount of degradation of blue pixels; and a compensation amount calculator configured to calculate each of the compensation amount of the degradation of the red pixels, the compensation amount of the degradation of the green pixels, and the compensation amount of the degradation of the blue pixels, based on the amount of the degradation of the red pixels, the amount of the degradation of the green pixels, the amount of the degradation of the blue pixels and an accumulation amount of red image data, green image data, and blue image data.

6. The display device of claim 5, wherein each of the first sensing circuit, the second sensing circuit, and third sensing circuit comprises an integrator configured to integrate the power current.

7. The display device of claim 5, wherein the sensing block further comprises a noise eliminator configured to reduce noise of the power current.

8. The display device of claim 5, wherein the compensation amount calculator is configured to:

divide the display panel into a plurality of regions;

calculate the compensation amount of the degradation of the red pixels of each of the regions by multiplying the amount of the degradation of the red pixels provided from the sensing block by a ratio of the accumulation amount of the red image data provided to all of the regions to the accumulation amount of the red image data provided to each of the regions;

calculate the compensation amount of the degradation of the green pixels of each of the regions by multiplying the amount of the degradation of the green pixels provided from the sensing block by a ratio of the accumulation amount of the green image data provided to all of the regions to the accumulation amount of the green image data provided to each of the regions; and calculate the compensation amount of the degradation of the blue pixels of each of the regions by multiplying the amount of the degradation of the blue pixels provided from the sensing block by a ratio of the accumulation amount of the blue image data provided to all of the regions to the accumulation amount of the blue image data provided to each of the regions.

9. The display device of claim 1, wherein the degradation compensator is coupled to the power voltage generator or located in the power voltage generator.

10. The display device of claim 1, wherein the degradation compensator is coupled to the timing controller or located in the timing controller.

11. An electronic device comprising a display device and a processor configured to control the display device, the display device comprising:

a display panel comprising a plurality of pixels;

a power voltage generator configured to generate a high power voltage that is provided to the pixels through a high power line;

a degradation compensator configured to calculate a degradation degree of the pixels by measuring a power current flowing through the high power line, and to calculate a compensation amount of a degradation of the pixels based on the degradation degree of the pixels and image data provided to the pixels;

a scan driver configured to provide scan signals to the pixels;

a data driver configured to provide data signals to the pixels; and a timing controller configured to generate control signals to control the power voltage generator, the degradation compensator, the scan driver, and the data driver.

12. The electronic device of claim 11, wherein the degradation compensator comprises:

a sensing block comprising a sensing circuit configured to calculate an amount of the degradation corresponding to the degradation degree of the pixels based on the power current; and a compensation amount calculator configured to calculate the compensation amount of the degradation of the pixels based on the amount of the degradation of the pixels and an accumulation amount of the image data.

13. The electronic device of claim 12, wherein the sensing circuit comprises an integrator configured to integrate the power current.

14. The electronic device of claim 12, wherein the compensation amount calculator is configured to divide the display panel into a plurality of regions, and to calculate the compensation amount of the degradation of each of the regions by multiplying the amount of the degradation provided from the sensing block by a ratio of the accumulation amount of the image data provided to all of the regions to the accumulation amount of the image data provided to each of the regions.

15. The electronic device of claim 11, wherein the degradation compensator comprises:

a sensing block comprising:

a first sensing circuit configured to calculate an amount of degradation of red pixels;

a second sensing circuit configured to calculate an amount of degradation of green pixels; and a third sensing circuit configured to calculate an amount of degradation of blue pixels; and a compensation amount calculator configured to calculate each of the compensation amount of the degradation of the red pixels, the compensation amount of the degradation of the green pixels, and the compensation amount of the degradation of the blue pixels, based on the amount of the degradation of the red pixels, the amount of the degradation of the green pixels, the amount of the degradation of the blue pixels and an accumulation amount of red image data, green image data, and blue image data.

16. The electronic device of claim 15, wherein each of the first sensing circuit, the second sensing circuit, and third sensing circuit comprises an integrator configured to integrate the power current.

17. The electronic device of claim 15, wherein the sensing block further comprises a noise eliminator configured to reduce noise of the power current.

18. The electronic device of claim 15, wherein the compensation amount calculator is configured to:

divide the display panel into a plurality of regions;

calculate the compensation amount of the degradation of the red pixels of each of the regions by multiplying the amount of the degradation of the red pixels provided from the sensing block by a ratio of the accumulation amount of the red image data provided to all of the regions to the accumulation amount of the red image data provided to each of the regions;

calculate the compensation amount of the degradation of the green pixels of each of the regions by multiplying the amount of the degradation of the green pixels provided from the sensing block by a ratio of the accumulation amount of the green image data provided to all of the regions to the accumulation amount of the green image data provided to each of the regions; and calculate the compensation amount of the degradation of the blue pixels of each of the regions by multiplying the amount of the degradation of the blue pixels provided from the sensing block by a ratio of the accumulation amount of the blue image data provided to all of the regions to the accumulation amount of the blue image data provided to each of the regions.

19. The electronic device of claim 11, wherein the degradation compensator is coupled to the power voltage generator or located in the power voltage generator.

20. The electronic device of claim 11, wherein the degradation compensator is coupled to the timing controller or located in the timing controller.

* * * * *